US008376543B2

(12) United States Patent
Nitta

(10) Patent No.: US 8,376,543 B2
(45) Date of Patent: Feb. 19, 2013

(54) RECORDING APPARATUS AND SHEET PROCESSING METHOD

(75) Inventor: Tetsuhiro Nitta, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 200 days.

(21) Appl. No.: 12/834,651

(22) Filed: Jul. 12, 2010

(65) Prior Publication Data

US 2011/0012972 A1 Jan. 20, 2011

(30) Foreign Application Priority Data

Jul. 14, 2009 (JP) ..... 2009-165788

(51) Int. Cl.

| | |
|---|---|
| ***B41J 2/01*** | (2006.01) |
| ***B41J 25/308*** | (2006.01) |
| ***B41J 29/38*** | (2006.01) |
| ***B41J 29/393*** | (2006.01) |
| ***B41J 2/165*** | (2006.01) |

(52) U.S. Cl. ..... 347/104; 347/8; 347/14; 347/19; 347/22

(58) Field of Classification Search ..... None
See application file for complete search history.

(56) References Cited

U.S. PATENT DOCUMENTS

| | | | | |
|---|---|---|---|---|
| 5,790,168 | A * | 8/1998 | Sano et al. | 347/262 |
| 7,084,892 | B2 * | 8/2006 | Sugiura | 347/175 |
| 2006/0114280 | A1 * | 6/2006 | Koide et al. | 347/16 |
| 2007/0222806 | A1 | 9/2007 | Ito | |

FOREIGN PATENT DOCUMENTS

| | | | |
|---|---|---|---|
| EP | 1785279 | A2 | 5/2007 |
| JP | 07-117910 | A | 5/1995 |
| JP | 08-216465 | A | 8/1996 |
| JP | 2004-098327 | A | 4/2004 |
| JP | 2006-188352 | A | 7/2006 |

* cited by examiner

*Primary Examiner* — Stephen Meier
*Assistant Examiner* — Alexander C Witkowski
(74) *Attorney, Agent, or Firm* — Canon U.S.A., Inc. IP Division

(57) ABSTRACT

An apparatus includes a guide unit configured to guide surfaces of a sheet, which is conveyed after passing through a recording unit, with respect to a vertical direction, the guide unit having an interval variable in the vertical direction, and a correction mechanism for correcting skew of the sheet, which is inserted into the guide unit, by pushing the sheet from both sides thereof in a sheet width direction. The interval of the guide unit in the vertical direction widens when the sheet is cut compared with that when correction is executed by the correction mechanism, and when the sheet is cut, conveyance of the sheet is temporarily stopped in a position of the cutter. In cutting, a loop of the sheet is formed on the guide unit the interval of which in the vertical direction has widened.

16 Claims, 9 Drawing Sheets

RECORDING APPARATUS AND SHEET PROCESSING METHOD

BACKGROUND OF THE INVENTION

1. Field of the Invention

The present invention relates to a recording apparatus for recording an image on a continuous sheet.

2. Description of the Related Art

In a recording apparatus having the function of executing recording on a continuous sheet to cut the sheet for each unit length, a technique to correct the skew of the sheet is important. For example, a recording apparatus discussed in Japanese Patent Application Laid-Open No. 2004-98327 includes a mechanism to detect an inclination by a sensor and execute skew correction by a skew roller. In a case in which the inclination of a sheet is large when the sheet is cut with the skew remaining uncorrected, the sheet may be cut on a skew to cut off the end of a recorded image. Thus, in this case, the sheet is not cut and discharged as it is.

In Japanese Patent Application Laid-Open No. 2004-98327, when the sheet is not cut and discharged, a user is later forced into cutting by hand. Thus, it is inconvenient. In particular, when a large quantity of different images is continuously recorded and discharged, if sheets different in length are mixed among cut sheets stacked on a discharge tray, this causes the user to be confused. Even if the user extracts only a sheet large in length to cut by hand, the order of images may be changed. If the order is significant, it becomes inconvenient.

SUMMARY OF THE INVENTION

According to an aspect of the present invention, a recording apparatus includes a recording unit configured to record data on a sheet, a guide unit configured to guide, in a first direction, at least one surface of the sheet, wherein the sheet is conveyed to the guide unit from the recording unit, the guide unit having an interval variable in the first direction, a correction unit configured to correct skew of the sheet, which is received by the guide unit, by urging the sheet from at least one side thereof in a second direction which is perpendicular to the first direction, and a cutting unit configured to cut the sheet having undergone skew-correction by the correction unit, wherein the guide unit is configured such that the interval of the guide unit in the first direction is wider when the sheet is at a position to be cut by the cutting unit than that when skew correction is executed by the correction unit, the recording apparatus further comprising a control unit for temporarily stopping conveyance of the sheet when the sheet is at the position to be cut by the cutting unit.

According to another aspect of the present invention, a sheet processing method includes guiding, with a guide unit, at least one surface of a sheet in a first direction along a conveying path, correcting skew of the sheet, received by the guide unit, by urging the sheet from at least one side thereof in a second direction which is perpendicular to the first direction, setting an interval of the guide unit in the first direction to be wider when the sheet is at a cutting position than when skew correction is executed, and temporarily stopping conveyance of the sheet in a cutting position.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

As an exemplary embodiment of the present invention, a printer of an inkjet method using a line type print head will be described as an example. In this description, "printer" is not limited to an apparatus for exclusive use specialized in a print function. "Printer" includes a multifunction peripheral combining the print function and the other functions, a manufacturing apparatus for forming an image and a pattern on the media, and the like.

Figure 1:
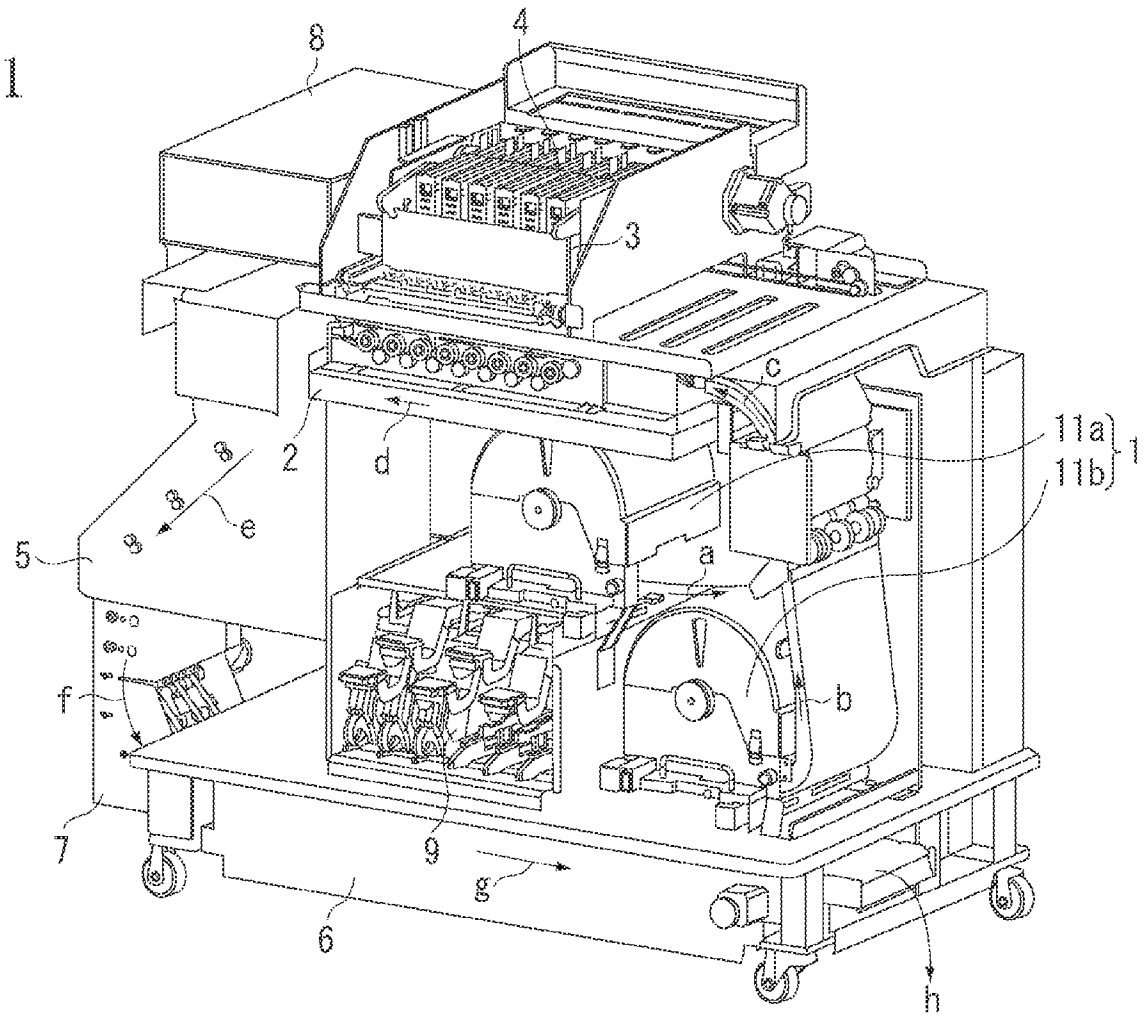
FIG. 1 illustrates the whole configuration of a printer according to an exemplary embodiment of the present invention.

FIG. 1 illustrates the whole configuration of a printer using a sheet roll (continuous sheet longer than a length of a print unit is wound in a roll pattern). The whole apparatus includes a sheet roll unit 1, a conveyance unit 2, a head unit 3, a print head 4, a cutter unit 5, a drying unit 6, a speed absorption unit 7, a control unit 8, and an ink tank 9. These are disposed in a casing of the apparatus. The control unit 8 contains a control section including a controller and various types of input-output (I/O) interfaces, and is responsible for various types of control of the whole apparatus.

The sheet roll unit 1 includes both of an upper stage sheet cassette 11*a* and a lower stage sheet cassette 11*b*. A user fits a sheet roll on a holder and inserts it into a printer main body from the front to fit it. A sheet pulled out from the upper stage sheet cassette 11*a* is conveyed in a direction of arrow a in FIG. 1 and a sheet pulled out from the lower stage sheet cassette 11*b* is conveyed in a direction of arrow b in FIG. 1. The sheet from either unit also travels in a direction of arrow c in FIG. 1 to reach the conveyance unit 2. The conveyance unit 2 conveys the sheet in a direction of arrow d (horizontal direction) in FIG. 1 in process of printing by a plurality of rotating rollers. Above the conveyance unit 2, the head unit 3 is oppositely disposed. On the head unit 3, the independent print head 4 for a plurality of colors (six colors) is retained along a conveyance direction of the sheet. In synchronization with conveyance of the sheet by the conveyance unit 2, ink is discharged from the print head 4 to form an image on the sheet. The recording unit includes the conveyance unit 2, the head unit 3, and the print head 4. The ink tank 9 independently stores ink of each color. The ink is supplied from the ink tank 9 to a sub tank provided corresponding to each color by a tube. The ink is supplied from the sub tank to each print head 4 by a tube. The control unit 8 includes a controller and various types of I/O interfaces, and is responsible for various types of control of the whole apparatus.

The sheet discharged from the conveyance unit 2 is conveyed in a direction of arrow e and inserted into the cutter unit 5. In the cutter unit 5, the sheet (sheet roll) is cut into a length of a predetermined print unit. The length of the predetermined print unit is different according to the size of an image to be printed. For example, in an L size photograph, the length in the conveyance direction is 135 mm. In an A4 size, the length in the conveyance direction will be 297 mm.

The drying unit 6 is a unit configured to heat the sheet passing through inside the unit in a direction of arrow g in FIG. 1 with warm air in order to dry the sheet applied with ink in a short time. The sheet cut into a unit length passes through inside the drying unit 6 one by one, is discharged in a direction of arrow h in FIG. 1, and is stacked on a discharge tray. On a conveyance channel, between the cutter unit 5 and the drying unit 6, the speed absorption unit 7 for absorbing a difference in conveyance speed of the front and the rear is provided. On the speed absorption unit 7, the sheet is conveyed in a direction of arrow f in FIG. 1.

Figure 2:
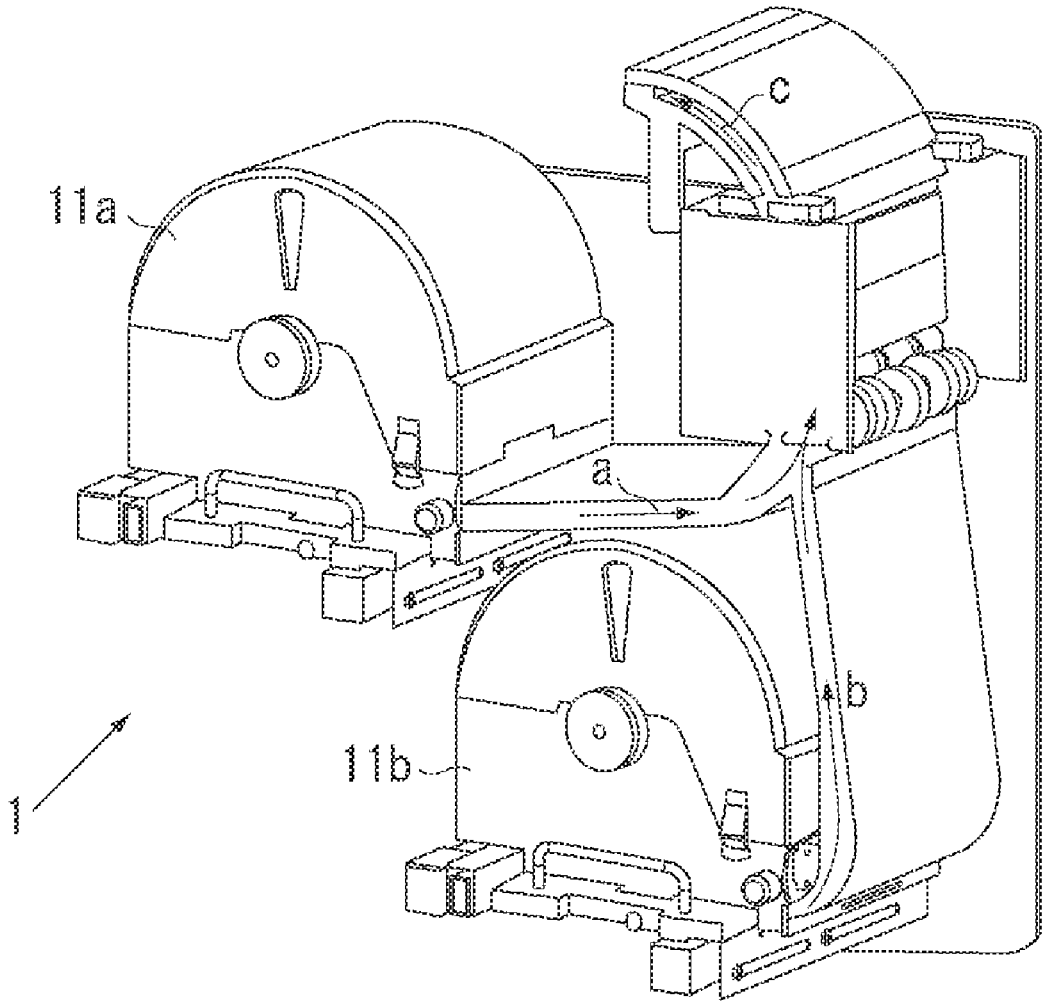
FIG. 2 illustrates the configuration of a sheet roll unit.

FIG. 2 illustrates the configuration of the sheet roll unit 1. In each of the upper stage sheet cassette 11*a* and the lower stage sheet cassette 11*b*, the sheet roll is loaded. Each cassette can be loaded with the sheet roll having various sheet widths. In FIG. 2, the upper stage sheet cassette 11*a* is loaded with a sheet having a minimum width and the lower stage sheet cassette 11*b* is loaded with a sheet having a maximum width. The sheet roll pulled out from either of the sheet cassettes is supplied to the conveyance unit 2. A conveyance speed at this time is a speed A (e.g., 75 mm/sec.). This speed is equal to a speed A of the sheet that is conveyed by the conveyance unit 2 in process of printing operation.

Figure 3:
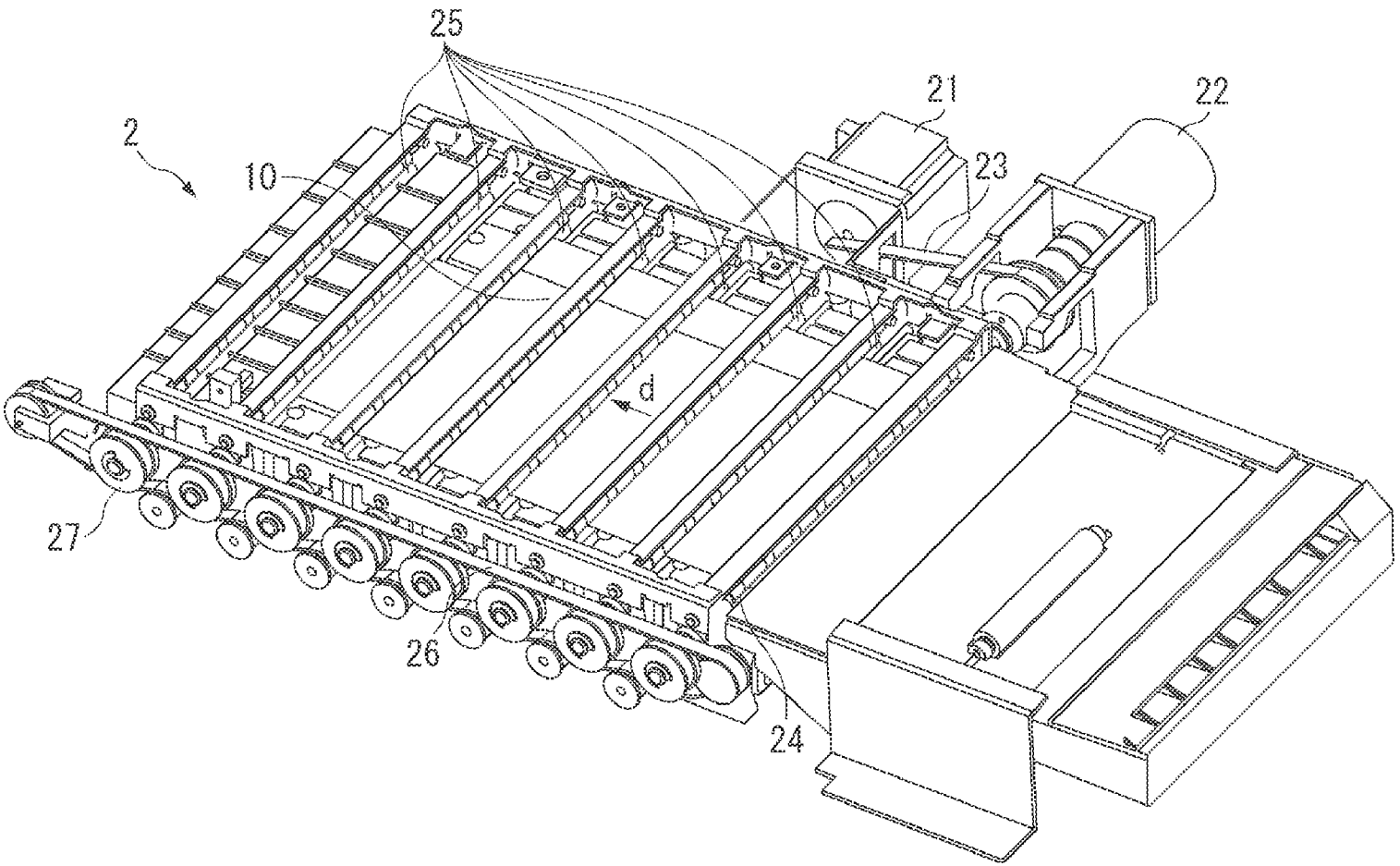
FIG. 3 illustrates the configuration of a conveyance unit.

FIG. 3 illustrates the configuration of the conveyance unit 2. The rotation driving force of a conveyance motor 21 is transmitted by a belt 23 and a conveyance roller 24 is rotated. The state of rotation (rotation angle) of the conveyance roller 24 is detected by a rotary encoder 22. Based on output of detection by the rotary encoder 22, the conveyance motor 21 is subjected to feedback control and also ink discharge timing for printing is controlled. The rotation driving force of the conveyance roller 24 is transmitted to a plurality of feed rollers 25 (in this example, seven) by a transmission mechanism of a belt 26 and a pulley 27. All of the plurality of feed rollers 25 and the conveyance roller 24 are rotated at the same circumferential speed to convey the sheet 10. A conveyance speed of the sheet 10 in process of print operation is a fixed speed A.

Figure 4:
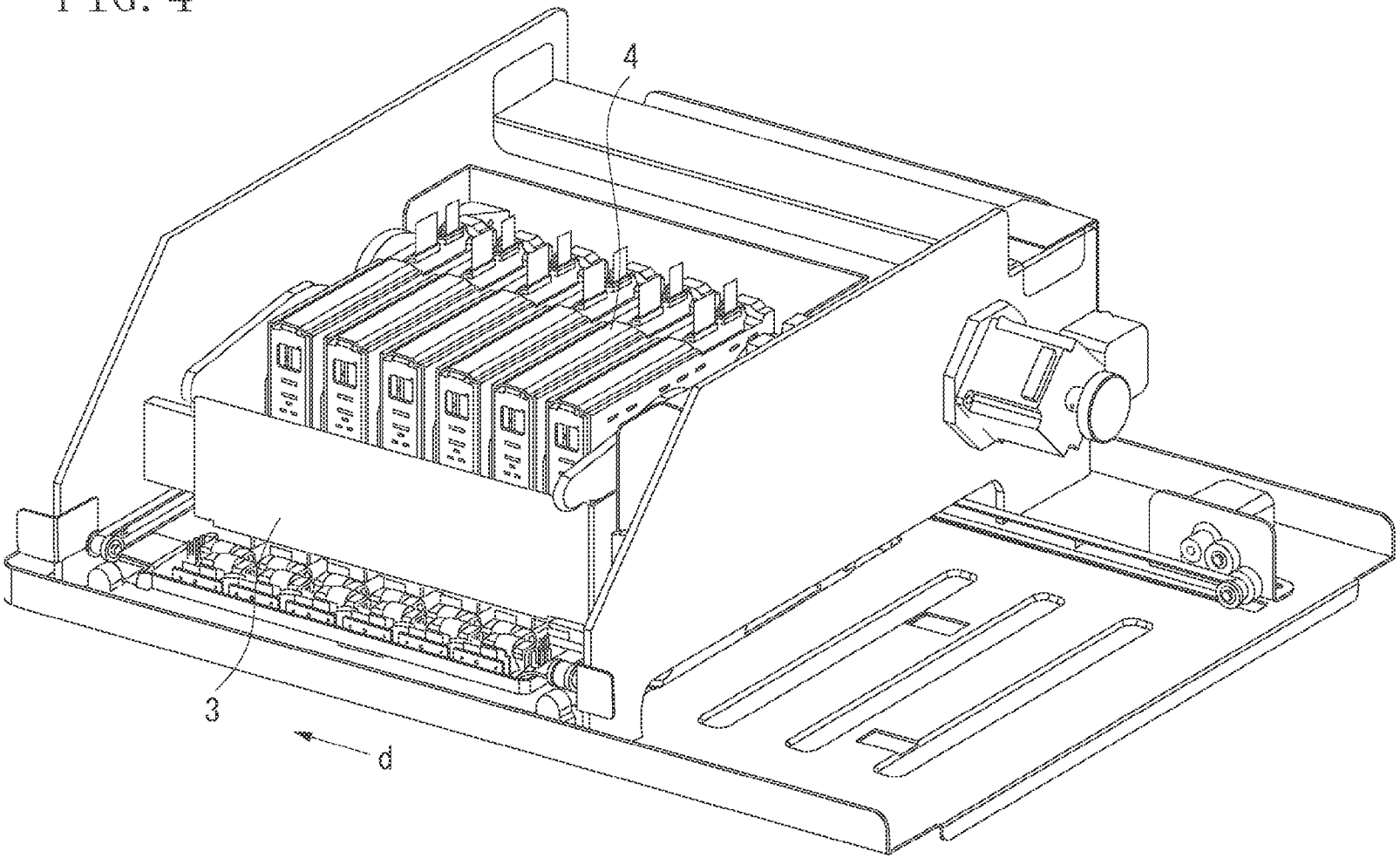
FIG. 4 illustrates the configuration of a head unit.

FIG. 4 illustrates the configuration of the head unit 3. On the print head 4, heads for respective colors (six colors) are aligned along a direction of arrow d in printing. A lined head of each color may be seamlessly formed by a single nozzle chip. A divided nozzle chip may regularly be aligned in a line or a staggered array. In the present exemplary embodiment, a so-called full multi head is used in which nozzles are aligned in the range that the width of a maximum sheet to be used is covered. As an inkjet method for discharging ink from a nozzle, methods of using a heater element, a piezoelectric element, an electrostatic element, or a micro electromechanical systems (MEMS) element can be employed. Based on print data, ink is discharged from a nozzle of each head. The timing of discharge is determined by an output signal of the rotary encoder 22. The present invention is not limited to a printer of the inkjet method but is applicable to various print methods such as a thermal printer (sublimation type, thermal transfer type, etc.) and a laser printer.

Figure 5:
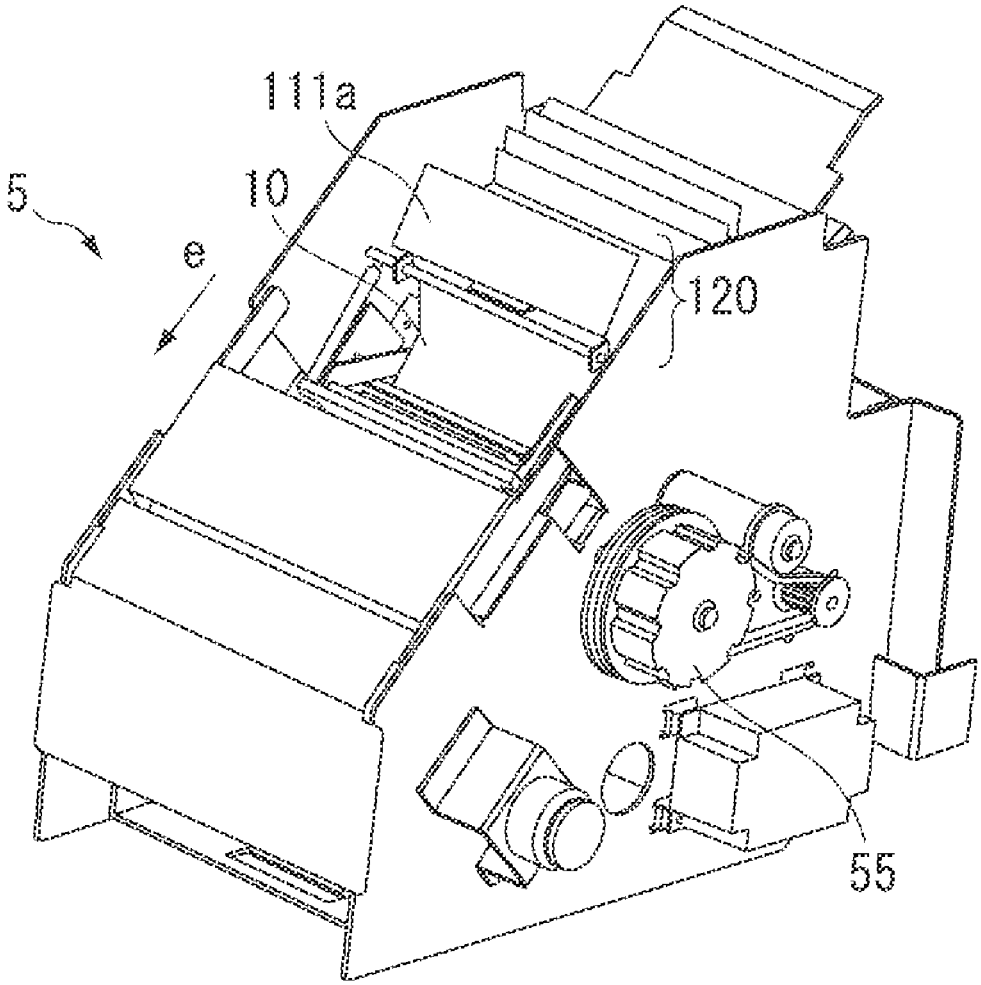
FIG. 5 illustrates the configuration of a cutter unit.

FIG. 5 illustrates the configuration of the cutter unit 5. In the cutter unit 5, the sheet is conveyed in a direction of arrow e in FIG. 5. A conveyance speed when entering the cutter unit 5 is the same speed A as the conveyance speed in the conveyance unit 2. A motor 55 is a driving source for conveying the sheet in the cutter unit 5. Further, on the cutter unit 5, a correction mechanism 120 for correcting the skew of the sheet 10 is provided. An upper guide plate 111*a* is a member included in the correction mechanism 120. The detail thereof will be described below.

Figure 6:
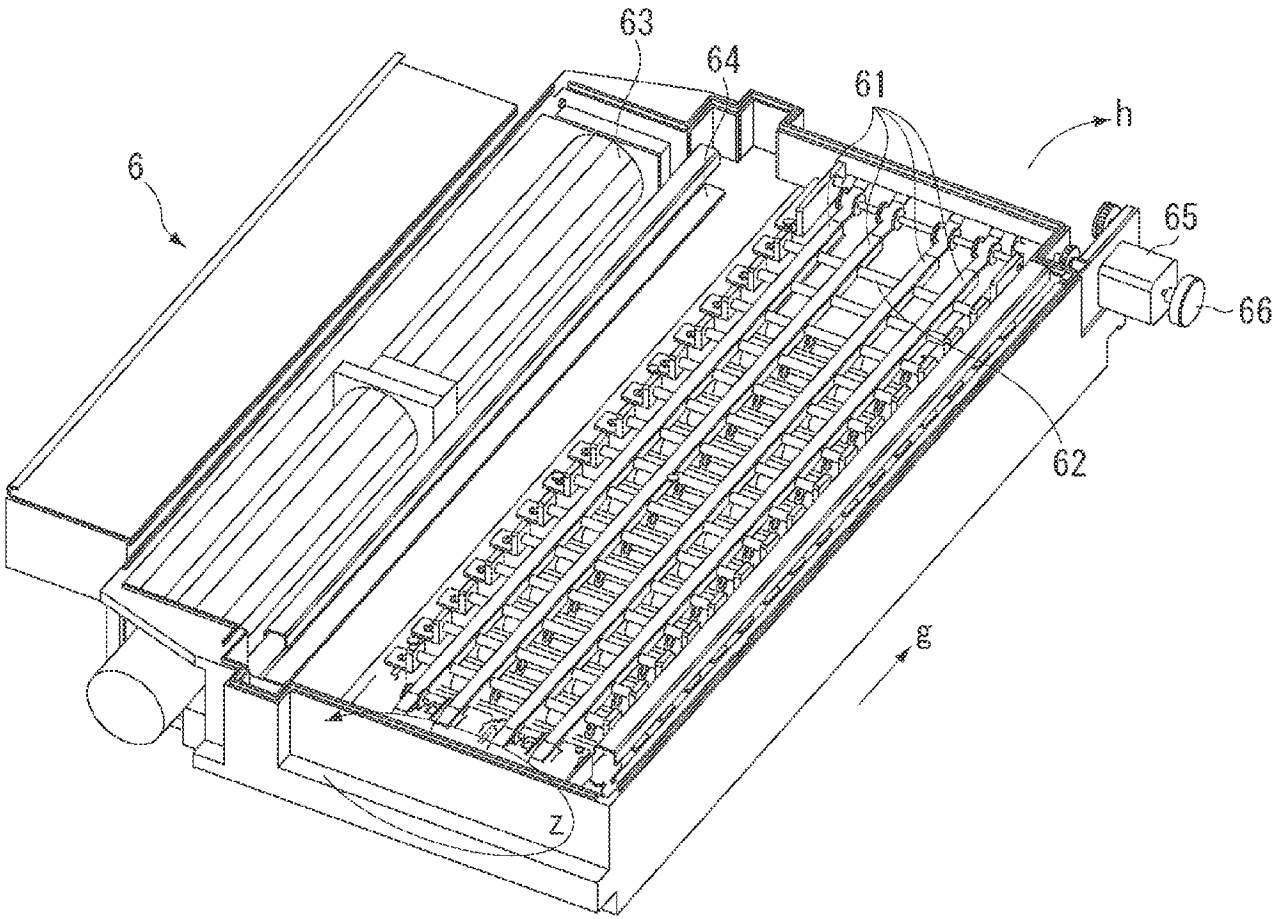
FIG. 6 illustrates the configuration of a drying unit.

FIG. 6 illustrates the configuration of the drying unit 6. The sheet is shifted while being interposed between a plurality of conveyance belts 61 and a plurality of rollers 62. To the plurality of conveyance belts 61, the rotation driving force of a motor 65 is transmitted. The state of rotation of the motor 65 is detected by a rotary encoder 66 and the motor 65 is subjected to feedback control. A print face which is applied with ink and needed to be dried is turned downward. Air heated by a heater 64 is circulated in a direction of arrow z in FIG. 6 by a fan 63 to facilitate drying of the sheet to be conveyed in a direction of arrow g in FIG. 6 at the speed A. By fast drying, the sheet easily causes a curvature. However, the sheet is interposed between the conveyance belt 61 and the roller 62 during drying, the curvature is suppressed.

The configuration and the operation of the correction mechanism 120 contained in the cutter unit 5 illustrated in FIG. 5 will be described. The following operation sequence is executed based on a command from the control section of the control unit 8.

Figure 7:
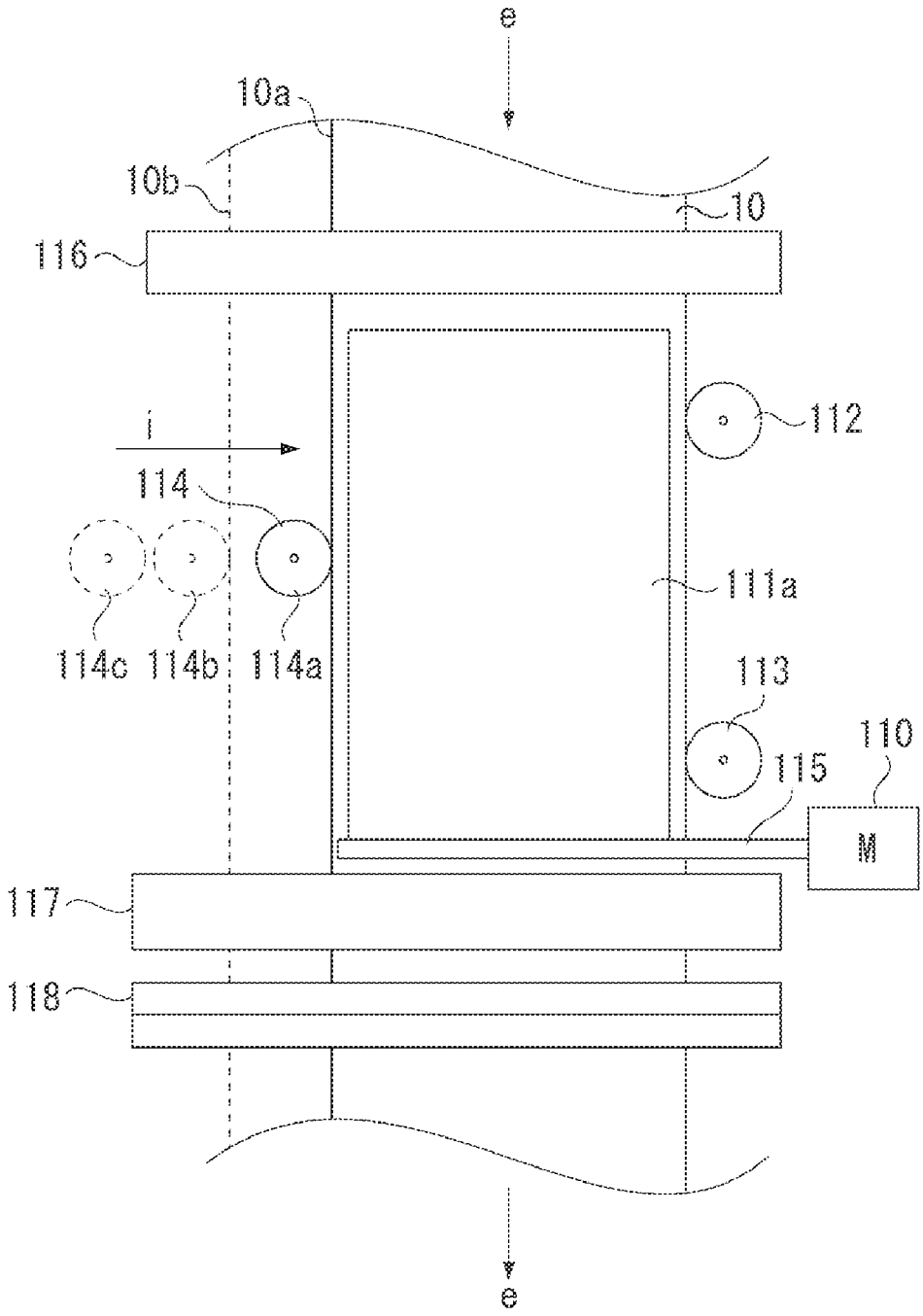
FIG. 7 is a top view illustrating the configuration of a correction mechanism.
Figure 8A:
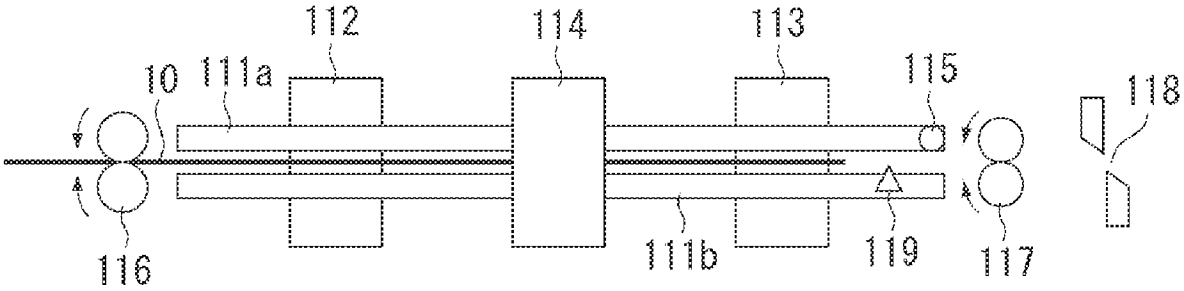
FIGS. 8A and 8B are cross-sectional views illustrating the configuration of a correction mechanism.
Figure 8B:
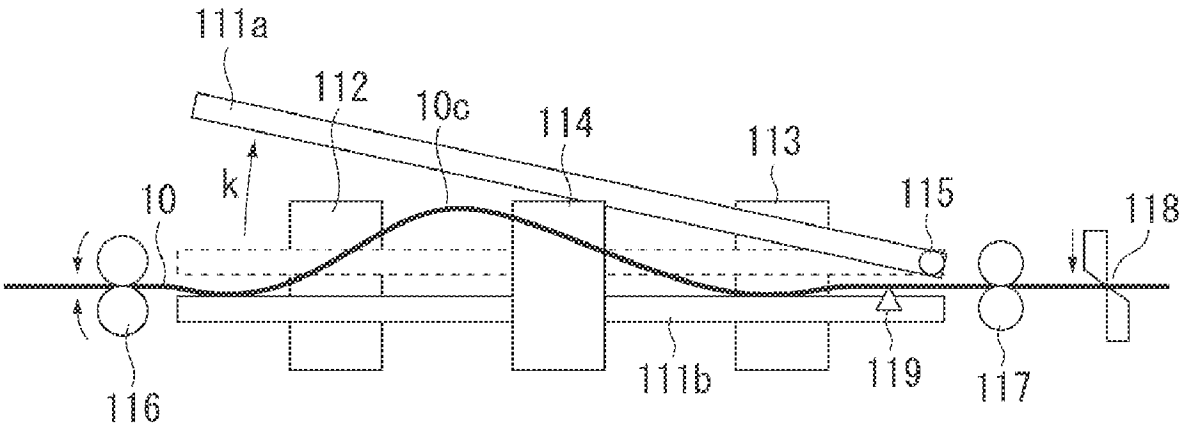

FIG. 7 illustrates the configuration of the correction mechanism 120 and is a top view of the sheet 10 as viewed from above. FIGS. 8A and 8B illustrate cross-sectional views of the correction mechanism 120 as viewed from the side. As a correction mechanism for correcting the skew of the sheet by pushing the sheet 10 from both sides thereof in a direction of the sheet width, a roller mechanism, which includes two reference guide rollers 112 and 113 and one movable guide roller 114, is provided. Both of the reference guide rollers 112 and 113 are retained in a secured position so as to be freely rotated and brought into contact with one side of the sheet 10 in a width direction at two places. Thus, it is determined that the sheet turns toward a correct direction. On another side of the sheet 10 in a width direction, the movable guide roller 114, which can be shifted in the width direction, is retained so as to be freely rotated. The movable guide roller can be shifted at a predetermined stroke in a direction of arrow i in FIG. 7. When the tip of the continuous long sheet 10 is inserted into the guide unit, before the tip of the sheet reaches a conveyance roller 117, the movable guide roller 114 is shifted in the direction of arrow i. The sheet 10 is pushed on the side of the reference guide rollers 112 and 113 to position the sheet at three places. Thus, even if a skew is present, the sheet can be corrected toward a correct direction.

In the apparatus in the present exemplary embodiment, the width of the sheet 10 can correspond to various sizes. A sheet 10*a* in FIG. 7 is a sheet having a minimum width supplied from the upper stage sheet cassette 11*a*, whereas a sheet 10*b* illustrated by a dashed line is a sheet having a maximum width supplied from the lower stage sheet cassette 11*b*. In order to deal with a difference between the minimum width and the maximum width, the movable guide roller 114 has a shift stroke by a distance obtained by adding a margin of skew to a distance of the difference between the minimum width and the maximum width of a sheet that is assumed to be used. A position 114*c* is a waiting position of the movable guide roller 114. The movable guide roller 114 is shifted from the position 114*c* to a position 114*b* with respect to the sheet 10*b* having the maximum width. An interval between two positions 114*c* and 114*b* is a margin of skew. Further, the movable guide roller 114 is shifted from the position 114*c* to a position

114*a* with respect to the sheet 10*a* having the minimum width. A distance between two positions 114*b* and 114*a* corresponds to a difference between the minimum width and the maximum width of the sheet. Furthermore, when a sheet has an intermediate size between the minimum width and the maximum width, the movable guide roller 114 is shifted to an intermediate position between the position 114*a* and the position 114*b*. The control section performs control to shift the movable guide roller 114 to a suitable position within a stroke corresponding to the size of a sheet to be used.

Further, in order to guide the sheet 10 by pushing surfaces of the sheet 10 from above and below (with respect to a vertical direction), the upper guide plate 111*a* and the lower guide plate 111*b* are provided, and the guide unit is formed with both the guide plates 111*a* and 111*b*. FIG. 8A illustrates the state of the guide unit when skew correction is executed. In order to prevent buckling (locally large bend and fold) of a sheet when the sheet is interposed from both sides in a width direction and pushed thereon, in the guide unit, the top and the bottom are narrowed to the utmost to form a conveyance channel. Furthermore, as illustrated in FIG. 8B, the upper guide plate 111*a* is rotated about a support shaft 115 provided at the end on the downstream side. For this rotation, a driving force of a motor mechanism 110, which is a driving source, is provided to the support shaft 115. The lower guide plate 111*b* does not move and is continuously secured. A position of the upper guide plate 111*a* in the open state in FIG. 8A is a first position and a position of the upper guide plate 111*a* in the closed state in FIG. 8B is a second position.

On the downstream side of the guide unit, the conveyance roller 117 and a cutter 118 are provided. The cutter 118 is an auto cutter mechanism such as a circle cutter, a guillotine cutter, or a rotary cutter, which automatically cuts a sheet by a vertical blade. On the side more upstream than the cutter 118 and the conveyance roller 117, and also in the vicinity of the most downstream of the guide unit, a sensor 119 for detecting the tip of a sheet is provided. The sensor 119 also detects the cutting position of a sheet other than the tip of the sheet. The cutting position is a blank portion between images continuously formed by the recording unit. In the blank portion, a sheet is cut for each predetermined unit length corresponding to the size of an image.

In the above configuration, the sheet 10 is inserted into the guide unit at the speed A by the conveyance roller 116 on the side more upstream than the guide unit. When the sensor 119 has detected that the tip of the sheet is inserted into the guide unit, before the sheet reaches the conveyance roller 117, the movable guide roller 114 is shifted to a suitable position corresponding to the size of a sheet to be used. Thus, the sheet is interposed from both sides in a width direction to provide a suitable pushing force. While the sheet is shifted, on the guide unit, as illustrated in FIG. 8A, while buckling is prevented with the sheet vertically narrowly guided, the sheet is securely subjected to skew correction. The sheet 10 the direction of which is rightly corrected is interposed and retained by the conveyance roller 117, which rotates at the conveyance speed A, and then reaches the cutter 118. At this time, since the cutting blade of the cutter 118 is in an open state as illustrated in FIG. 8A, the tip of the sheet travels further ahead.

The sensor 119 optically detects a cut mark or a predetermined blank formed between an image of a first sheet and an image of a second sheet to detect a cutting position of the sheet. A predetermined unit length is determined according to the size of an image. Thus, the cutting position can roughly be predicted. In a roughly predicted range, an accurate cutting position is detected by the sensor 119. When the sensor 119 detects the cutting position of the sheet, the control section conveys the sheet 10 until the cutting position is located on the cutting blade of the cutter 118 and then temporarily stops only the conveyance roller 117. Even if the conveyance roller 117 in the vicinity of the position of the cutter 118 is temporarily stopped, the conveyance roller 116 on the side more upstream than that continues rotation. The cutter 118 accurately cuts the sheet whose conveyance is temporarily stopped in the position of the cutter 118.

Simultaneously when the conveyance roller 117 is stopped or slightly prior to the stop, the control section controls the motor mechanism 110 to rotate the upper guide plate 111*a* from the first position to the second position in a direction of arrow k in FIG. 8B. Thus, the interval of the guide unit in a vertical direction widens when the sheet is cut by the cutter 118 compared with that when correction is executed by the correction mechanism 120. When the upper guide plate 111*a* reaches the second position, on the guide unit, a wedge-shaped space is formed in which the interval of the guide unit in a vertical direction widens on the upstream side along a direction to which the sheet is conveyed and gradually narrows with travel toward the downstream side. While the sheet is cut, the conveyance roller 117 is stopped but the conveyance roller 116 continues rotation. Thus, the sheet is fed from the upstream side to the guide unit with the downstream side interrupted and the idle portion of the sheet 10 forms a loop 10*c* in the wedge-shaped space of the guide unit. Since the upper guide plate 111*a* escapes to the second position, the guide unit becomes wide in interval to provide a sufficient space. Thus, formation of the loop 10*c* is not obstructed.

When the sheet has been cut by the cutter 118, the control section starts rotation of the conveyance roller 117 to restart conveyance of the sheet in the position of the cutter 118. At this time, the conveyance roller 117 is set with a rotation speed so as to be conveyed at a speed B larger than the speed A (e.g., speed 1.5 to 2 times as high as the speed A). A cut sheet having one unit length cut as described above is discharged from the cutter unit 5, passes through the speed absorption unit 7, and is fed to the drying unit 6.

The conveyance roller 116 continuously conveys the sheet at the fixed speed A. Thus, the loop 10*c* of the sheet 10 is gradually dissipated by a difference in speed (B−A). Timing to dissipate the loop 10*c* is determined based on the speed A, the speed B, a time required for the speed 0 to reach the speed B, a time required for the speed B to reach the speed A, and a time required for cutting by the cutter 118 (each speed or time is a determined fixed value). In timing to dissipate the loop 10*c*, the control section performs control so that the conveyance roller 117 reduces a conveyance speed from the speed B to the speed A, thereby eliminating a difference in speed between the conveyance roller 117 and the conveyance roller 116. Only when the tip of the sheet is inserted into the guide unit and the skew correction is executed, the upper guide plate 111*a* is located in the first position to narrow the interval between the vertical guides. Thereafter, the upper guide plate 111*a* is located in the second position. After the upper stage sheet cassette 11*a* and the lower stage sheet cassette 11*b* are switched, or after the sheet role is replaced, the tip of the sheet is inserted.

The cut sheet having one unit length cut as described above is discharged from the cutter unit 5, passes through the speed absorption unit 7, and is fed to the drying unit 6.

The recording unit records a plurality of images for each unit length while conveying the sheet at the fixed speed A. Also in an image after the second sheet, when the cutting position is detected by the sensor 119, similarly the sheet is cut for each predetermined unit length.

Figure 9:
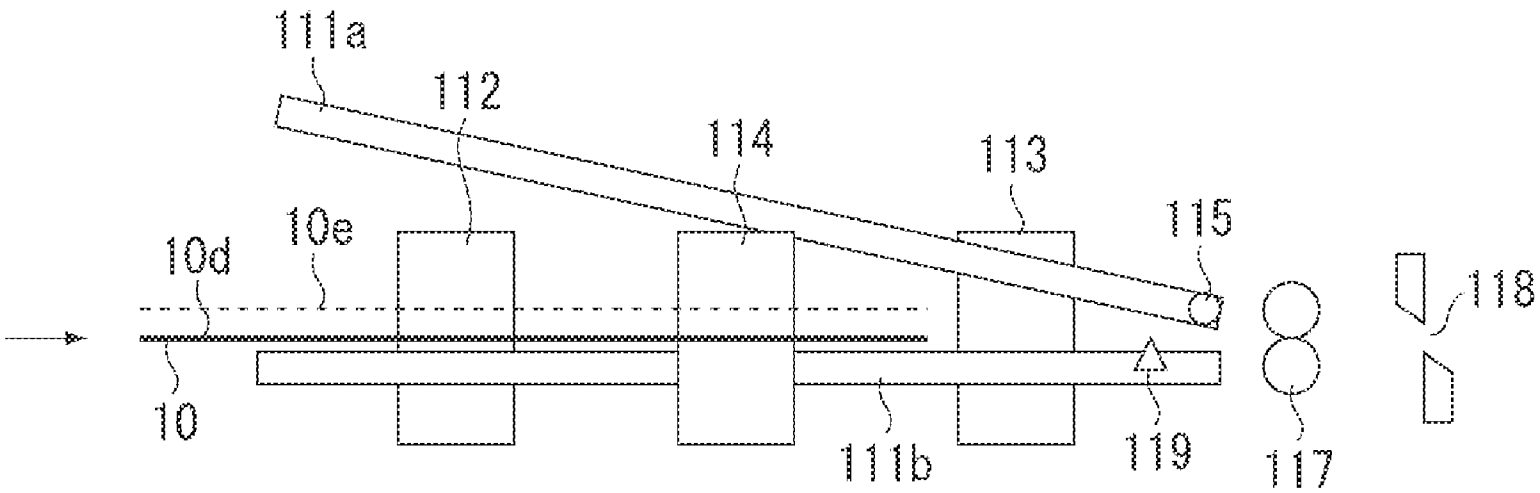
FIG. 9 illustrates the operation of a correction mechanism according to another exemplary embodiment of the present invention.

When the tip of the continuous sheet is inserted into the guide unit, a conveyance defect such as jamming can be reduced when the upper guide plate 111*a* opens a large space in the second position. Thus, in an initial state, as illustrated in FIG. 9, the upper guide plate 111*a* may be located in the second position. When the tip of the sheet is inserted, the position may be switched to the first position, then the movable guide roller 114 may be shifted, and the skew correction may also be executed. Even if the sheet 10 is inserted into the position 10*e* deviating from the original position 10*d*, the conveyance defect does not occur and reliability is improved.

According to the above-described present exemplary embodiment, the recording apparatus includes the guide unit the interval of which in a vertical direction (first direction) is variable and the correction mechanism for correcting the skew of the sheet with the sheet present on the guide unit interposed from both sides in a width direction of the sheet (second direction). Then, the interval of the guide unit in a vertical direction is controlled so as to widen when the sheet is cut by the cutter compared with that when the correction is executed by the correction mechanism and also when the sheet is cut by the cutter, conveyance of the sheet is controlled so as to be temporarily stopped in the position of the cutter. When the sheet is cut by the cutter, on the guide unit the interval of which in the vertical direction widens, the loop of the sheet is formed. This allows a highly reliable recording apparatus and sheet processing method capable of executing secure skew correction and cutting of a sheet to be realized.

Further, in a layout of the apparatus in the present exemplary embodiment, there are no places to unnaturally bend a sheet. Thus, the apparatus can deal with sheets having various types of stiffness and realizes a printer compatible with miniaturization of the apparatus and various types of sheets. Furthermore, as the arrangement in which the sheet roll unit 1, the recording unit, and the drying unit 6, each having a large volume, are stacked in a direction of gravity, a sheet is roughly circumferentially circulated in the apparatus in order of processing. Thus, a printer having a small installation area (footprint) is realized.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-165788 filed Jul. 14, 2009, which is hereby incorporated by reference herein in its entirety.

What is claimed is:

1. A recording apparatus comprising:

a recording unit configured to record an image on a continuous sheet;

a guide unit configured to guide movement of the sheet, wherein the sheet is conveyed to the guide unit from the recording unit, the guide unit forming an interval which is variable in a direction perpendicular to a surface of the sheet;

a correction unit configured to correct skew of the sheet, which is received by the guide unit, by urging the sheet from at least one side thereof in a width direction of the sheet; and a cutting unit, provided downstream of the guide unit, configured to cut the sheet having undergone skew-correction by the correction unit, along the width direction of the sheet, wherein the guide unit is configured such that the interval is changed to be wider when the sheet is cut by the cutting unit than when skew correction is executed by the correction unit, and when the sheet is cut by the cutting unit, the apparatus is configured to temporarily stop conveyance of a portion of the sheet in the vicinity of the cutting unit and continue conveyance of the sheet on a side upstream from the guide unit, thereby forming a loop of the sheet within the interval.

2. The recording apparatus according to claim 1, wherein the guide unit is configured, when the sheet is at the position to be cut by the cutting unit, to form a wedge-shaped space in which the interval of the guide unit widens on an upstream side along a direction to which the sheet is conveyed and gradually narrows with travel toward a downstream side towards the cutting unit.

3. The recording apparatus according to claim 1, wherein the guide unit is configured such that the interval of the guide unit is wider when the sheet is cut by the cutting unit compared with that when an edge of the sheet is inserted into the guide unit.

4. The recording apparatus according to claim 1, wherein the apparatus is configured to be controlled such that the conveyance of the sheet at a first speed during recording the image on the sheet and, after the sheet is cut by the cutting unit, to discharge the sheet from the cutting unit at a second speed higher than the first speed.

5. The recording apparatus according to claim 4, wherein the apparatus is configured, after the sheet has been conveyed at the second speed for a predetermined period of time, to reduce the second speed to a speed substantially equal to the first speed.

6. The recording apparatus according to claim 1, wherein the correction unit comprises a correction mechanism having a reference guide roller provided on one side of the sheet in the width direction of the sheet and a movable guide roller which can be shifted in the width direction of the sheet provided on another side of the sheet to correct skew such that the sheet is positioned between the reference guide roller and the movable guide roller.

7. The recording apparatus according to claim 6, wherein the movable guide roller has a shift stroke of a distance obtained by adding a margin of skew to a distance of a difference between a minimum width and a maximum width of a sheet that is assumed to be used, and the movable guide roller is configured to be shifted towards the reference guide roller by a distance dependent upon a size of the sheet to be used.

8. The recording apparatus according to claim 1, wherein in an initial state, the guide unit forms a wide interval, and after an edge of the sheet is inserted into the guide unit, the guide unit forms a narrower interval, and thereafter the correction unit executes the skew correction.

9. The recording apparatus according to claim 1, wherein a roller is provided between the guide unit and the cutting unit, and wherein the apparatus is configured, when the sheet is to be cut by the cutting unit, to stop rotation of the roller.

10. The recording apparatus according to claim 9, wherein a sensor is provided upstream from the cutting unit for detecting an edge of the sheet, and after the sensor detects the end of the sheet, the correction unit executes the skew correction.

11. The recording apparatus according to claim 10, wherein the sensor is configured to detect a cutting position of the sheet, and, the apparatus is configured, when the sensor detects the cutting position, to stop the conveyance of the roller after a predetermined time, and then cutting unit is configured to cut the sheet.

12. The recording apparatus according to claim 1, wherein the recording unit has a plurality of full multi print heads, corresponding to respective different colors, for use in an inkjet method for discharging ink.

13. A sheet processing method comprising:

guiding, a continuous sheet with a guide unit;

correcting skew of the sheet, which is received by the guide unit from a recording unit, by urging the sheet from at least one side thereof in a width direction of the sheet;

cutting the sheet, having undergone skew-correction at a cutting position downstream of the guide unit, along the width direction of the sheet;

changing an interval of the guide unit in a direction perpendicular to a surface of the sheet, to be wider when the sheet is cut than when skew correction is executed; and when the sheet is cut, temporarily stopping conveyance of a portion of the sheet in a vicinity of the cutting position and continuing conveyance of the sheet on a side upstream of the cutting position, thereby forming a loop of the sheet in the interval.

14. The sheet processing method according to claim 13, further comprising:

cutting the temporarily stopped sheet; and restarting conveyance of the portion of sheet at the cutting position after the sheet is cut.

15. The sheet processing method according to claim 13, further comprising forming a wedge-shaped space in which the interval of the guide unit widens on the upstream side along a direction to which the sheet is conveyed and gradually narrows with travel toward a downstream side towards the cutting unit.

16. The sheet processing method according to claim 13, wherein the guide unit is configured, in an initial state, to have a wide interval in the first direction, and the guide unit is further configured, after an edge of the sheet is inserted into the guide unit, to have a narrower interval in the first direction, and thereafter correction is executed by the correction unit.

* * * * *